US007535450B2

(12) United States Patent
Willis

(10) Patent No.: US 7,535,450 B2
(45) Date of Patent: May 19, 2009

(54) METHOD AND APPARATUS FOR SPARKLE REDUCTION USING A SPLIT LOWPASS FILTER ARRANGEMENT

(75) Inventor: Donald Henry Willis, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 519 days.

(21) Appl. No.: 10/078,778

(22) Filed: Feb. 19, 2002

(65) Prior Publication Data

US 2003/0156091 A1 Aug. 21, 2003

(51) Int. Cl.
*G09G 3/36* (2006.01)

(52) U.S. Cl. ..... 345/98

(58) Field of Classification Search ..... 345/98, 345/531, 596, 213, 214, 204, 208, 211, 212, 345/52, 63, 80, 94, 99, 104; 348/623, 447; 250/226; 307/72

See application file for complete search history.

(56) References Cited

U.S. PATENT DOCUMENTS

| | | | | |
|---|---|---|---|---|
| 4,523,230 | A * | 6/1985 | Carlson et al. | 348/623 |
| 5,019,904 | A * | 5/1991 | Campbell | 348/447 |
| 5,247,169 | A * | 9/1993 | Okada et al. | 250/226 |
| 5,990,755 | A | 11/1999 | Takaaki | |
| 6,211,859 | B1 * | 4/2001 | Lin et al. | 345/596 |
| 6,961,039 | B2 | 11/2005 | Willis | |
| 7,064,735 | B2 | 6/2006 | Murade | |
| 2002/0126075 | A1 | 9/2002 | Willis | |
| 2002/0126079 | A1 | 9/2002 | Willis et al. | 345/89 |
| 2002/0126080 | A1 | 9/2002 | Willis et al. | |
| 2002/0126134 | A1 | 9/2002 | Willis et al. | |
| 2003/0142099 | A1 * | 7/2003 | Deering et al. | 345/531 |

FOREIGN PATENT DOCUMENTS

| | | |
|---|---|---|
| CN | 1207845 | 2/1999 |
| EP | 1225558 A1 | 1/2002 |
| EP | 1239449 A2 | 3/2002 |
| EP | 1239450 A2 | 3/2002 |
| EP | 1249817 A2 | 3/2002 |
| KR | 20010021366 | 3/2001 |
| WO | WO 94/11854 | 5/1994 |
| WO | WO 99/52095 | 10/1999 |

OTHER PUBLICATIONS

Chinese Search Report dated May 27, 2007.

* cited by examiner

*Primary Examiner*—Sumati Lefkowitz
*Assistant Examiner*—Tammy Pham
(74) *Attorney, Agent, or Firm*—Robert D. Shedd; Harvey D. Fried; James McKenzie

(57) ABSTRACT

A circuit (10) for reducing errors due to adjacent pixel interdependence in a liquid crystal display includes a decomposer (12) for dividing an input signal into a plurality of signals having at least a high brightness signal and a low brightness signal, a delay match circuit (14) for the high brightness signal a split low pass filter arrangement (25) for the low brightness signal, and a combiner (24) for combining the delay matched high brightness signal and the filtered low brightness signal to provide an output, wherein the output signal has reduced sparkle.

14 Claims, 5 Drawing Sheets

10

100

METHOD AND APPARATUS FOR SPARKLE REDUCTION USING A SPLIT LOWPASS FILTER ARRANGEMENT

CROSS REFERENCE TO RELATED APPLICATIONS (Not applicable)

FIELD OF THE INVENTION

This invention relates to the field of video systems utilizing a liquid crystal display (LCD), and in particular, to video systems utilizing normally white liquid crystal on silicon imagers.

DESCRIPTION OF RELATED ART

Liquid Crystal on Silicon (LCOS) can be thought of as one large liquid crystal placed over a silicon wafer. The silicon wafer is divided into an incremental array of tiny plates. A tiny incremental region of the liquid crystal is influenced by the electric field generated by each tiny plate and a common plate. Each such tiny plate and corresponding liquid crystal region are together referred to as a cell of the imager. Each cell corresponds to an individually controllable pixel. Each tiny plate is also a mirror for reflecting back a cell's light. A common plate electrode is disposed on the other side of the liquid crystal.

The drive voltages are supplied to plate electrodes on each side of the LCOS array. In the presently preferred LCOS system to which the inventive arrangements pertain, the common plate is always at a potential of 8 volts. Each of the other plates in the array of tiny plates is operated in two voltage ranges. For positive pictures, the voltage varies between 0 volts and 8 volts. For negative pictures the voltage varies between 8 volts and 16 volts.

The light supplied to the imager, and therefore supplied to each cell of the imager, is field polarized. Incoming light is incident upon the common electrode which is transparent. Each liquid crystal cell rotates the polarization of the input light responsive to the RMS value of the electric field applied to the cell by the plate electrodes. Generally speaking, the cells are not responsive to the polarity (positive or negative) of the applied electric field. Rather, the brightness of each pixel's cell is generally only a function of the rotation of the polarization of the light incident on the cell. Furthermore, polarization rotation for each cell is a non-linear function of the electric field. Polarization rotation for a given cell occurs as the light passes through the liquid crystal both before and after reflection from the cell plate. It is the rotation of the polarization that is capable of being controlled. Light leaving the imager is approximately the same intensity, but a different polarization. This may depend on the intensity that is ultimately desired. It should be noted that it is undesirable to have the imager absorbing light because it can get too hot. The imager will get hot due to some spurious amount of absorption.

If adjacent pixels produce different brightness, then there must be a different potential on the 2 cell plates corresponding to the adjacent pixels. When potentials on adjacent cell plates are unequal, there is an electric field between them which is known as a fringing field. The fringing field has some components, which are orthogonal to the desired field. These orthogonal components are not a problem in the space between adjacent mirrors. But, the orthogonal components of the electric field, which is over the mirror, will have the effect of distorting the polarization rotation. This distortion results in a substantial local increase in brightness. This is a particular problem when the pixel is supposed to be dark, but is usually an insignificant problem when the pixels are intended to be bright since the pixels are not very different in voltage so the fringing field is not that great. Also, for dark pixels, the additional brightness is much more noticeable. Contrast ratio is also very important in making a high quality display. It is very important to achieve sufficient black level. A proportionately larger drive voltage is needed to create a slightly darker image in a normally white display. Often, a large difference in voltage between adjacent pixels is needed even if both pixels are low in brightness but not equal in brightness. This results in a major fringing field that produces a visible artifact denoted sparkle. Due to the rotational effects of the fringing fields, this phenomenon is also referred to as a declination error in the imager. Sparkle artifacts can be red, blue and/or green, but green is usually the most prominent color.

Because of the particular manufacturing process used for many imagers, horizontally adjacent pixels suffer more from the fringing field problem. Thus, a need exists for overcoming the sparkle problem described above.

SUMMARY

In a first aspect of the present inventions a circuit for adjacent pixel interdependence in a liquid crystal display comprises a decomposer for dividing an input signal into a plurality of signals having at least a high brightness signal and a low brightness signal, a delay matching circuit for processing the high brightness signal, a split low pass filter arrangement for independently low pass filtering rising transients and falling transients in the low brightness signal, and a combiner for combining the delayed high brightness signal with the filtered low brightness signal to provide an output signal with reduced sparkle artifacts.

In a second aspect of the present invention, a method for reducing adjacent pixel interdependence in a liquid crystal display comprises the steps of dividing an input signal into at least a high brightness signal and a low brightness signal, independently low pass filtering rising transients and falling transients in the low brightness signal to reduce adjacent pixel interdependence, and delay matching the high brightness signal with the filtered low brightness signal and combining the delay matched high brightness signal with the filtered low brightness signal to provide an output with reduced sparkle artifacts.

DETAILED DESCRIPTION

Figure 1:
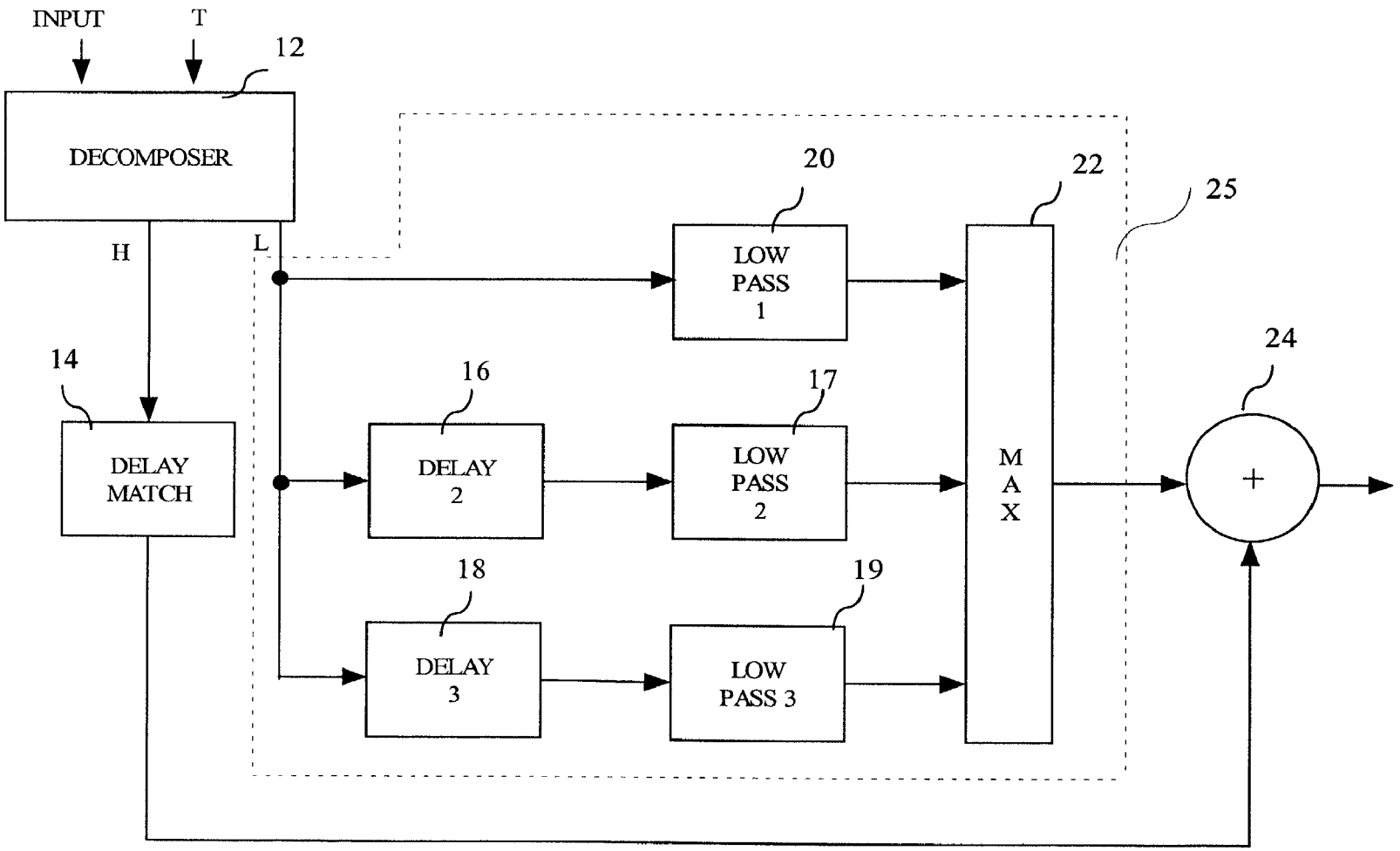
FIG. 1 is a block diagram showing a decomposer, split low pass filter arrangement with associated delay circuits, and a delay match circuit in accordance with the present invention.

Reducing the difference in brightness between adjacent pixels when they are dark, but not when they are bright can resolve the sparkle problem previously described. A device called a decomposer 12 on the input divides the input signal into at least two signals on a circuit 10 used to reduce sparkle or declination errors in liquid crystal displays as shown in FIG. 1. Sparkle or declination errors can also be considered a subset of a broader phenomenon known as adjacent pixel interdependence. It should be noted that the present invention is particularly useful for liquid crystal on silicon (LCOS) displays. The decomposer 12 serves as an amplitude discriminator for the input signal which is preferably an eight (8) bit video signal that preferably carries the desired brightness of one color component (Red, Green, or Blue).

The input signal is decomposed in a manner that enables obtaining the original signal when the decomposed or divided signals are added or combined back together. The method in accordance with the present invention would further process the low brightness portion (L) using a split low pass filter arrangement and delay match the high brightness portion (H). The low brightness portion is preferably processed with a split low pass filter arrangement having three different low pass filters. One low pass filter (see LPF3) acts on a dark going signal or transient to lengthen its fall time. Another low pass filter (see LPF1) acts ahead of the delayed bright going signal or transient to anticipate the transient and start the signal going brighter earlier. A third low pass filters acts to properly control the amplitude of narrow positive pulses. Then, the processed low and high brightness signals are recombined and sent to an imager. Accordingly, the improved approach relies upon one decomposer for each color (Red, Green, & Blue). It should be understood that the decomposer could divide the input signal into two or more component signals within contemplation of the present invention.

The decomposer should have at least two inputs. A threshold input (T) and a brightness input signal. The threshold signal would be used in dividing the brightness signal into a high brightness signal and a low brightness signal.

Referring once again to FIG. 1, the circuit 10 comprises the decomposer 12 for dividing an input signal into a plurality of signals having at least a high brightness signal (H) and a low brightness signal (L). A split low pass filter arrangement 25 in circuit 10 preferably comprises a low pass filter 19 preceded by a delay circuit 18 for acting on a dark going signal or transient to lengthen its fall time and comprises another low pass filter 20 that acts ahead of a bright going signal or transient to anticipate the transient and start the signal going bright earlier. The split low pass filter arrangement 25 also comprises yet another low pass filter 17 and another delay circuit 16, wherein this filter is usually selected to be symmetrical with a linear phase response. Finally, the split low pass filter arrangement 25 comprises a maximum selector circuit 22 that selects or forms a processed low brightness signal by selecting the maximum of the three filter (20, 17 or 19) outputs for each sample of video. The high brightness signal (H) is merely delay-matched (to provide a processed high brightness signal) using a delay-match circuit 14 and added back with the processed low brightness signal using a combiner or adder circuit 24.

Figure 2:
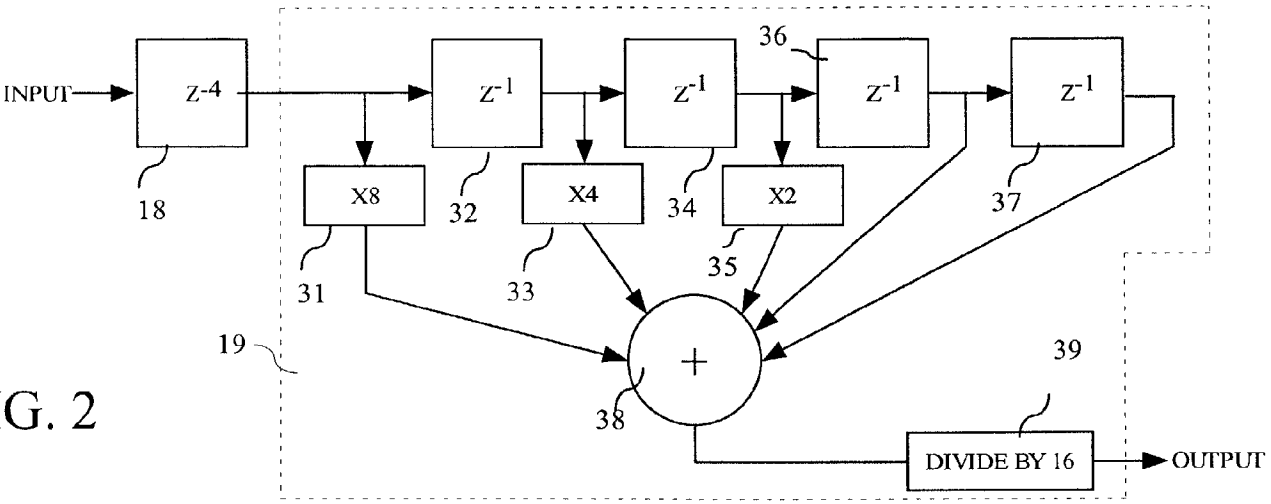
FIG. 2 is a more detailed block diagram of a delay circuit and low pass filter in the split filter arrangement in accordance with the present invention.

Referring to FIG. 2, the low pass filter 19 and delay circuit 18 are shown in greater detail. FIG. 2 shows an asymmetric 5-tap filter with non-ascending coefficients 8/16, 4/16, 2/16, 1/16, and 1/16 all preceded by a delay of 4 sample periods using delay circuit 18. Non-ascending coefficients are useful in obtaining a non-decreasing response on a leading edge of a pulse. The sample delays (18, 32, 34, 36, and 37) illustrated in FIG. 2 (as well as those shown in FIGS. 3 & 4) all use Z transform notation, wherein $Z^{-4}$ is a 4 clock latch delay and $Z^{-1}$ is a 1 clock delay for example. The low pass filter further preferably comprises multiplier circuits 31, 33, and 35 to appropriately weight the coefficients on each tap. The low pass filter 19 further comprises a combiner 38 for combining the signals from each tap and a divider 39 to normalize the output coming from the low pass filter 19.

Figure 3:
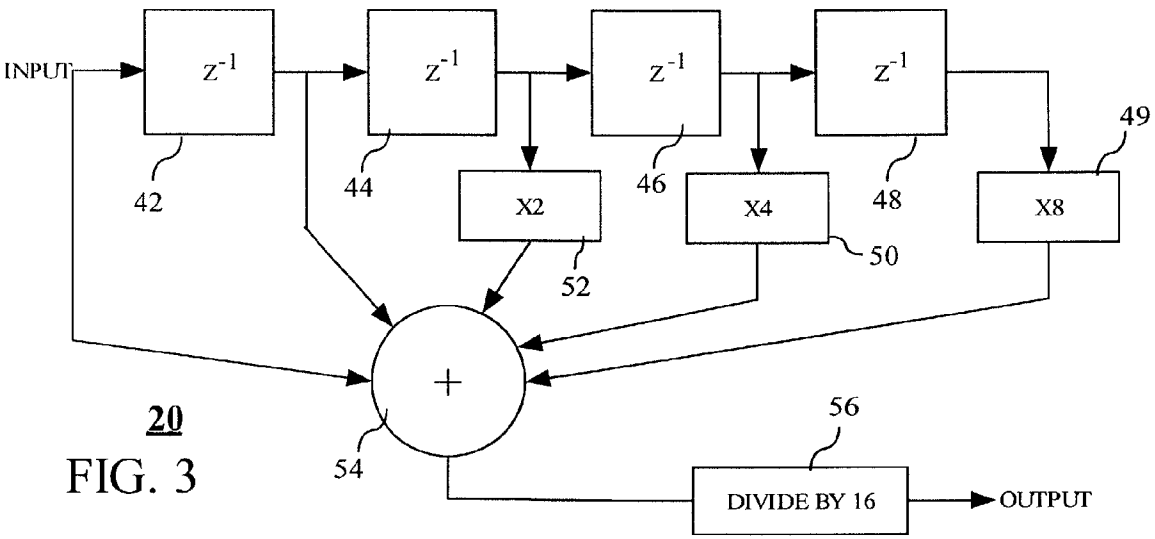
FIG. 3 is a more detailed block diagram of a low pass filter in the split filter arrangement in accordance with the present invention.

Referring to FIG. 3, the low pass filter 20 is shown in greater detail. FIG. 3 shows an asymmetric 5-tap filter with non-descending coefficients 1/16, 1/16, 2/16, 4/16 and 8/16. The non-descending coefficients are particularly useful in obtaining a non-increasing response from a trailing edge of a pulse. The low pass filter 20 also comprises sample delays 42, 44, 46, as well as multiplier circuits 52, 50, and 49 as shown to appropriately weight the coefficients on each tap. The low pass filter 20 further comprises a combiner 54 for combining the signals from each tap and a divider 56 to normalize the output coming from the low pass filter 20.

Figure 4:
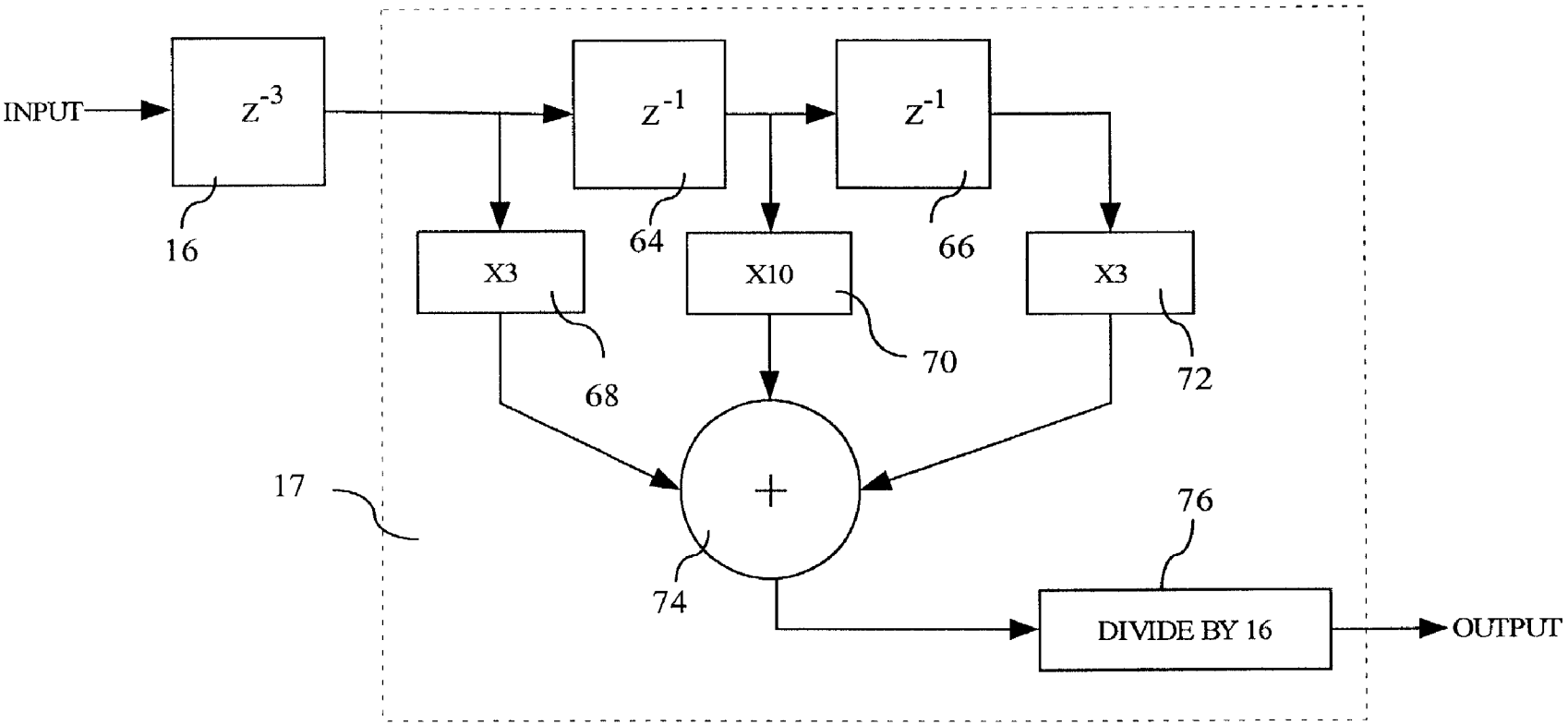
FIG. 4 is another more detailed block diagram of a delay circuit and low pass filter in the split filter arrangement in accordance with the present invention.

Referring to FIG. 4, the low pass filter 17 and delay circuit 16 are shown in greater detail. FIG. 4 shows a symmetric 3-tap filter with coefficients 3/16, 10/16, and 3/16 all preceded by a delay of 3 sample periods using delay circuit 16. The low pass filter 17 also comprises sample delays 64, 66 as well as multiplier circuits 68, 70, and 72 as shown to appropriately weight the coefficients on each tap. The low pass filter 17 further comprises a combiner 74 for combining the signals from each tap and a divider 76 to normalize the output coming from the low pass filter 17.

Figure 5:
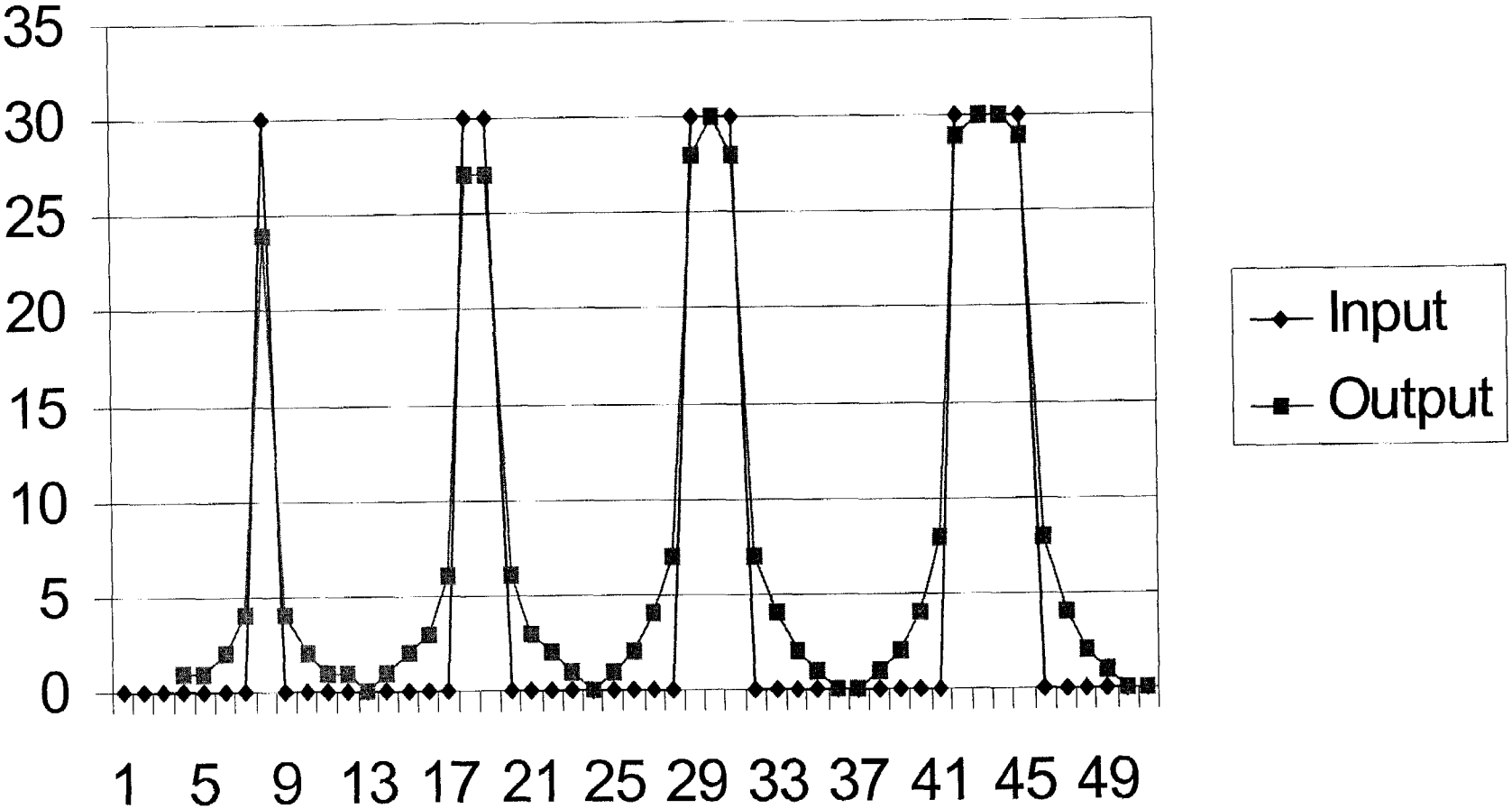
FIG. 5 is a graph illustrating the operation of a system in accordance with the present invention.

Referring to FIG. 5, an example of the operation of a system in accordance with the present invention is shown in the graph. For this example, the threshold is set to 16. The pulses are all of amplitude 30 and vary in width from 1 sample to 4 samples.

Figure 6:
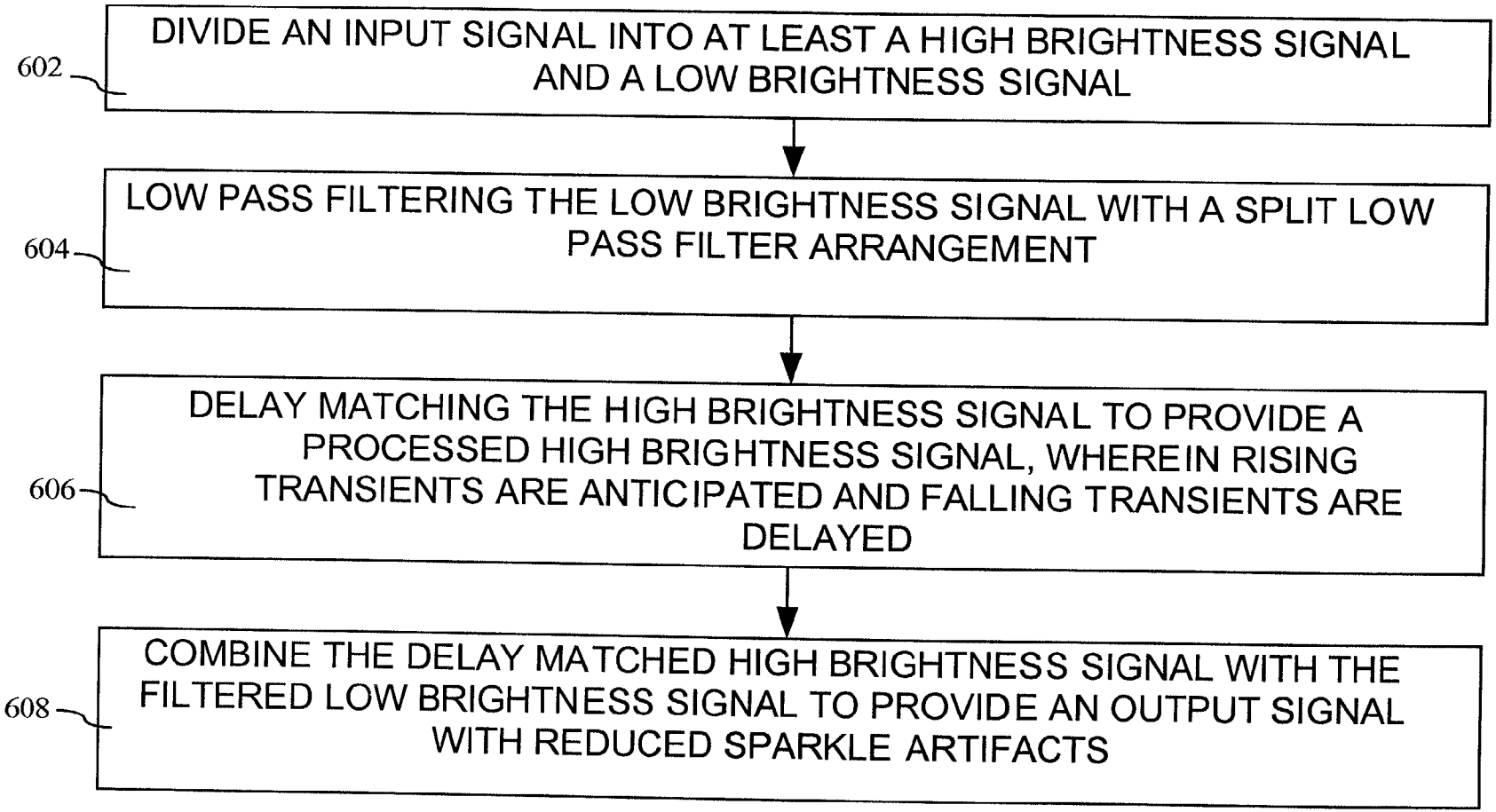
FIG. 6 is a flow chart illustrating a method in accordance with the present invention.

Referring to FIG. 6, a flow chart illustrating a method 600 for reducing sparkle in a liquid crystal display is shown. The method 600 preferably comprises the steps of dividing an input signal into at least a high brightness signal and a low brightness signal at step 602, processing the low brightness signal at step 604 by independently low pass filtering rising transients and falling transients in the low brightness signal to provide a processed low brightness signal and delay matching the high brightness signal at step 606 with delays in the filtered low brightness signal, wherein rising transients are anticipated and falling transients are delayed. This processing can also be thought of as pulse widening for positive pulses (or pulse narrowing for negative pulses) in order to reduce sparkle or declination errors as desired. This can also be though of as changing the shape of the rising and falling edges in the low brightness signal. The method 600 can further comprise the step of combining the delay matched high brightness signal with the filtered low brightness signal to provide an output signal with reduced sparkle artifacts. In the case where the low brightness signal is split into two signals, low pass filtering step 604 can comprise the steps of low pass filtering the low brightness signal according to a first filtering rate to generate a first filtered valued, delay matching and low pass filtering the low brightness signal according to a second filtering rate to generate a second filtered value as well as the step of selecting as the filtered output for use in the combining step the maximum among the first or second filtered values. Alternatively, in the case where the low brightness signal is split into three signals, the low pass filtering step 604 can comprise the steps of low pass filtering the low brightness signal according low pass filtering the low brightness signal according to a first filtering rate to generate a first filtered valued, delay matching and low pass filtering the low brightness signal according to a second filtering rate to generate a second filtered value, delay matching and low pass filtering the low brightness signal according to a third filtering rate to generate a third filtered value as well as the step of selecting as the filtered output for use in the combining step the maximum among the first, second or third filtered values Although the present invention has been described in conjunction with the embodiments disclosed herein, it should be understood that the foregoing description is intended to illustrate and not limit the scope of the invention as defined by the claims.

What is claimed is:

1. A circuit for reducing adjacent pixel interdependence in a liquid crystal display, comprising:

a decomposer for dividing an input video signal into a plurality of signals having at least a high brightness signal and a low brightness signal;

a split low pass filter arrangement for independently low pass filtering rising transients and lengthening a fall time of falling transients in said low brightness signal to reduce adjacent pixel interdependence, wherein the split low pass filter arrangement comprises at least two low pass filters at least one of which is comprised of asymmetrically weighted taps thereby anticipating a bright-going signal and starting the bright-going signal going brighter earlier, at least one associated delay circuit, and a maximum selector circuit; and, a delay matching circuit for the high brightness signal; and means for combining the delayed high brightness signal with the filtered low brightness signal to provide an output with reduced sparkle artifacts.

2. The circuit of claim 1, wherein the at least two low pass filters and at least one associated delay circuit comprise a first low pass filter circuit, a second low pass filter circuit with an associated delay circuit, and a third low pass filter circuit with another associated delay circuit, wherein the maximum selector circuit selects the maximum of the first, second, or third low pass filter circuits.

3. The circuit of claim 2, wherein the second low pass filter circuit is symmetrical with a linear phase response.

4. The circuit of claim 1, wherein the liquid crystal display is a liquid crystal on silicon (LCOS) display.

5. The circuit of claim 2, wherein the third low pass filter circuit comprises an asymmetric 5-tap filter with coefficients 8/16, 4/16, 2/16, 1/16, and 1/16 preceded by a delay of 4 sample periods.

6. The circuit of claim 2, wherein the first low pass filter comprises an asymmetric 5-tap filter with coefficients 1/16, 1/16, 2/16, 4/16, and 8/16.

7. The circuit of claim 2, wherein the second low pass filter comprises a symmetric 3-tap filter with coefficients 3/16, 10/16, and 3/16, preceded by a delay of 3 sample periods.

8. A method for reducing adjacent pixel interdependence in a liquid crystal display, comprises the steps of:

dividing an input video signal into at least a high brightness signal and a low brightness signal;

low pass filtering said low brightness signal according to a first filtering rate to generate a first filtered value;

delay matching and low pass filtering said low brightness signal according to a second filtering rate to generate a second filtered value;

selecting as a filtered output for use in said combining step the maximum of said first and second filtered values;

independently low pass filtering rising transients and falling transients in said low brightness signal to reduce adjacent pixel interdependence said low-pass filtering comprising an asymmetrically weighted low-pass filter;

delay matching the high brightness signal with said filtered low brightness signal; and, combining the delay matched high brightness signal and the filtered low brightness signal to provide an output signal with reduced sparkle artifacts.

9. The method of claim 8, wherein said low pass filtering step comprises the steps of delay matching and low pass filtering said low brightness signal according to a third filtering rate to generate a third filtered value; and selecting as a filtered output for use in said combining step the maximum of said first, second and third filtered values.

10. The method of claim 8, wherein said low pass filtering step comprises the step of changing the shape of rising and falling pulses edges in said low brightness signal.

11. A circuit for reducing adjacent pixel interdependence in a liquid crystal display, comprising:

a decomposer comprising:

an input for receiving a video signal comprising respective samples of pixel brightness values;

at least a high brightness output providing consecutive high brightness value samples and a low brightness output providing consecutive low brightness value samples;

said consecutive low pixel brightness value samples defining pulses;

a filter coupled to said low brightness output, wherein the filter comprises at least two low pass filters at least one of which is comprised of asymmetrically weighted taps, at least one associated delay circuit, and a maximum selector circuit; and, said filter adjusting transition times of said pulses so as to reduce adjacent pixel interdependence.

12. The circuit of claim 1 further comprising a combiner coupled to said filter and to said high brightness output for combining said high brightness samples with filtered low brightness samples to provide a filtered video signal having reduced adjacent pixel interdependence.

13. A method for reducing adjacent pixel interdependence in a liquid crystal display, comprises the steps of:

providing a video signal comprising respective samples of pixel brightness values;

decomposing said video signal to provide a first video signal portion comprising consecutive high brightness value samples and a second video signal portion comprising consecutive low brightness value samples;

said consecutive low pixel brightness value samples defining pulses; and filtering said second video signal portion according to a first filtering rate to generate a first filtered value, and delay matching and filtering said second video signal portion according to a second filtering rate to generate a second filtered value, said second video signal portion being filtered by an asymmetrically weighted filter to adjust transition times of said pulses so as to reduce adjacent pixel interdependence.

14. The method of claim 13 further comprising steps of:

delaying said first video signal portion; and combining said delayed first video signal portion with said filtered second video signal portion so as to provide a combined video signal having reduced adjacent pixel interdependence.

* * * * *